US011572804B2

(12) United States Patent
Bouchard et al.

(10) Patent No.: US 11,572,804 B2
(45) Date of Patent: Feb. 7, 2023

(54) SYSTEMS AND METHODS FOR INTERNAL SPLINE LUBRICATION

(71) Applicant: PRATT & WHITNEY CANADA CORP., Longueuil (CA)

(72) Inventors: Guy Bouchard, Mont Saint-Hilaire (CA); Louis Brillon, Varennes (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 478 days.

(21) Appl. No.: 16/849,523

(22) Filed: Apr. 15, 2020

(65) Prior Publication Data

US 2021/0324761 A1 Oct. 21, 2021

(51) Int. Cl.
*F01D 25/18* (2006.01)

(52) U.S. Cl.
CPC ..... *F01D 25/18* (2013.01); *F05D 2220/329* (2013.01); *F05D 2260/98* (2013.01)

(58) Field of Classification Search
CPC ..... F01D 25/18; F05D 2260/98; F05D 2220/329; F01M 1/108
USPC ..... 184/6.11
See application file for complete search history.

(56) References Cited

U.S. PATENT DOCUMENTS

| | | | | |
|---|---|---|---|---|
| 4,493,623 | A | 1/1985 | Nelson | |
| 4,932,501 | A | 6/1990 | Decker | |
| 5,119,905 | A | 6/1992 | Murray | |
| 9,732,630 | B2 | 8/2017 | Lucas | |
| 9,932,860 | B2 | 4/2018 | Stutz et al. | |
| 10,113,429 | B2 * | 10/2018 | McDonagh | F01D 25/18 |
| 2016/0032769 | A1 * | 2/2016 | Stutz | F16N 7/363 464/7 |

* cited by examiner

*Primary Examiner* — Michael R Mansen
*Assistant Examiner* — Mark K Buse
(74) *Attorney, Agent, or Firm* — Norton Rose Fulbright Canada LLP.

(57) ABSTRACT

A gas turbine engine, has: a shaft rotatable about a central axis and engaged at an end thereof to a rotatable load via a spline; a reference tube circumferentially extending around the shaft, the reference tube secured at a first end to the shaft for rotation therewith and a second end free relative to the shaft for measuring a deformation of the shaft, the reference tube defining at least one tube aperture therethrough; an oil nozzle fluidly connected to a source of lubricant, the oil nozzle defining an exit flow axis intersecting the at least one tube aperture for injecting oil through the reference tube, the shaft defining at least one shaft aperture extending therethrough, the oil nozzle aligned with the spline via the at least one tube aperture and the at least one shaft aperture.

20 Claims, 2 Drawing Sheets

SYSTEMS AND METHODS FOR INTERNAL SPLINE LUBRICATION

TECHNICAL FIELD

The application relates generally to gas turbine engines and, more particularly, to lubrication systems used in such engines.

BACKGROUND OF THE ART

A gas turbine engine has a lubrication system for circulating lubricant, also referred to as oil, through a plurality of components, such as bearings, spline couplings, and so on. In some cases, oil nozzles are used to jet the oil toward the components.

SUMMARY

In one aspect, there is provided a gas turbine engine, comprising: a shaft rotatable about a central axis and engaged at an end thereof to a rotatable load via a spline; a reference tube circumferentially extending around the shaft, the reference tube secured at a first end to the shaft for rotation therewith and a second end free relative to the shaft for measuring a deformation of the shaft, the reference tube defining at least one tube aperture therethrough; an oil nozzle fluidly connected to a source of lubricant, the oil nozzle defining an exit flow axis intersecting the at least one tube aperture for injecting oil through the reference tube, the shaft defining at least one shaft aperture extending therethrough, the oil nozzle aligned with the spline via the at least one tube aperture and the at least one shaft aperture.

In another aspect, there is provided a torque shaft assembly for a gas turbine engine, comprising: a shaft rotatable about a central axis and defining a spline at an end thereof for drivingly engaging a rotatable load; and a reference tube circumferentially extending around the shaft, the reference tube having a first end secured to the shaft for rotation therewith and a second end free relative to the shaft, the reference tube defining at least one tube aperture therethrough for receiving a jet of oil, the shaft defining at least one shaft aperture extending therethrough, a flow path extending from the at least one tube aperture to the spline via the at least one shaft aperture for lubricating the spline.

In yet another aspect, there is provided a method of lubricating a spline of a shaft of a gas turbine engine, the method comprising: surrounding a shaft with a reference tube having a first end secured to the shaft and a second end free relative to the shaft; injecting oil through at least one tube aperture defined through the reference tube; directing the injected oil toward the spline via at least one shaft aperture defined through the shaft; and lubricating the spline with the injected oil.

DESCRIPTION OF THE DRAWINGS

Reference is now made to the accompanying figures in which.

DETAILED DESCRIPTION

Figure 1:
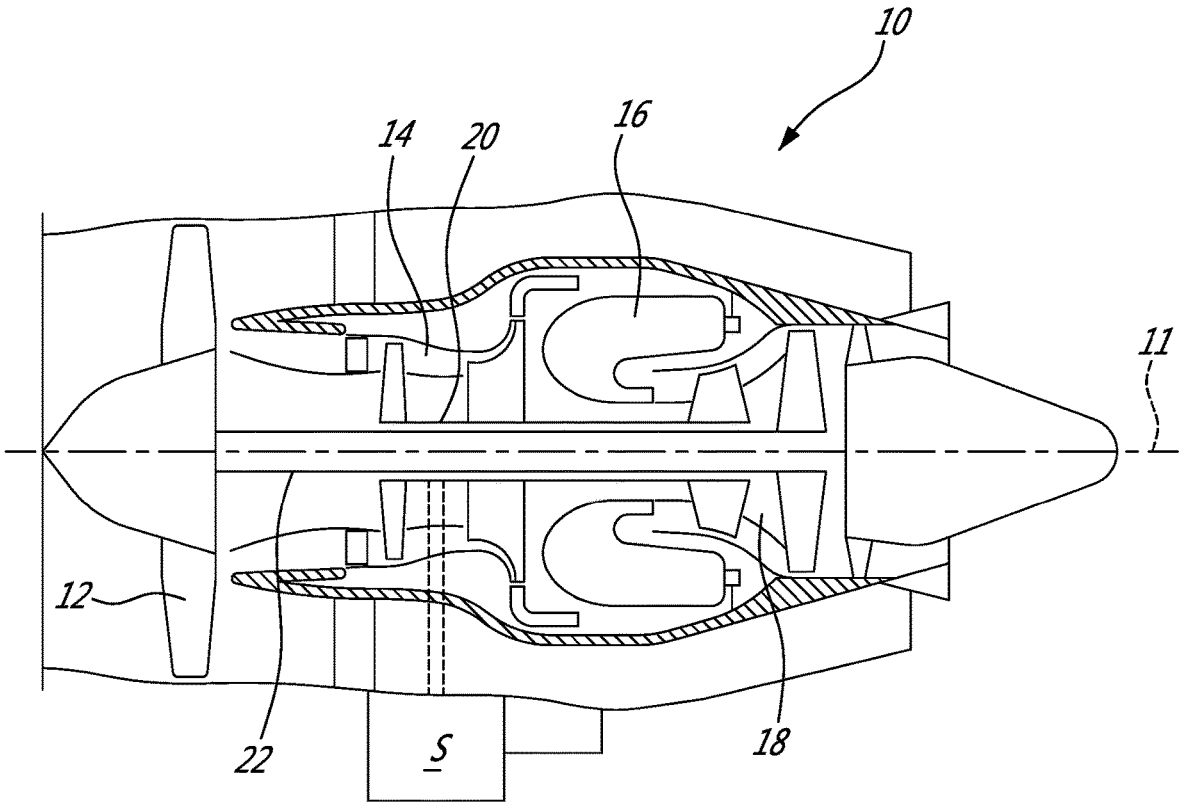
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a compressor section 14 for pressurizing the air, a combustor 16 in which the compressed air is mixed with fuel and ignited for generating an annular stream of hot combustion gases, and a turbine section 18 for extracting energy from the combustion gases. The fan 12, the compressor section 14, and the turbine section 18 are rotatable about a central axis 11 of the engine 10. The engine 10 may include a low-pressure shaft 22 and a high pressure shaft 20. In the embodiment shown, the low- and high-pressure shafts 22, 20 are concentric and rotatable about the central axis 11. The engine 10 may include a lubrication system S for circulating lubricating oil toward and from components in need of lubrication. These components may include, for instance, bearings, spline, and so on.

Figure 2:
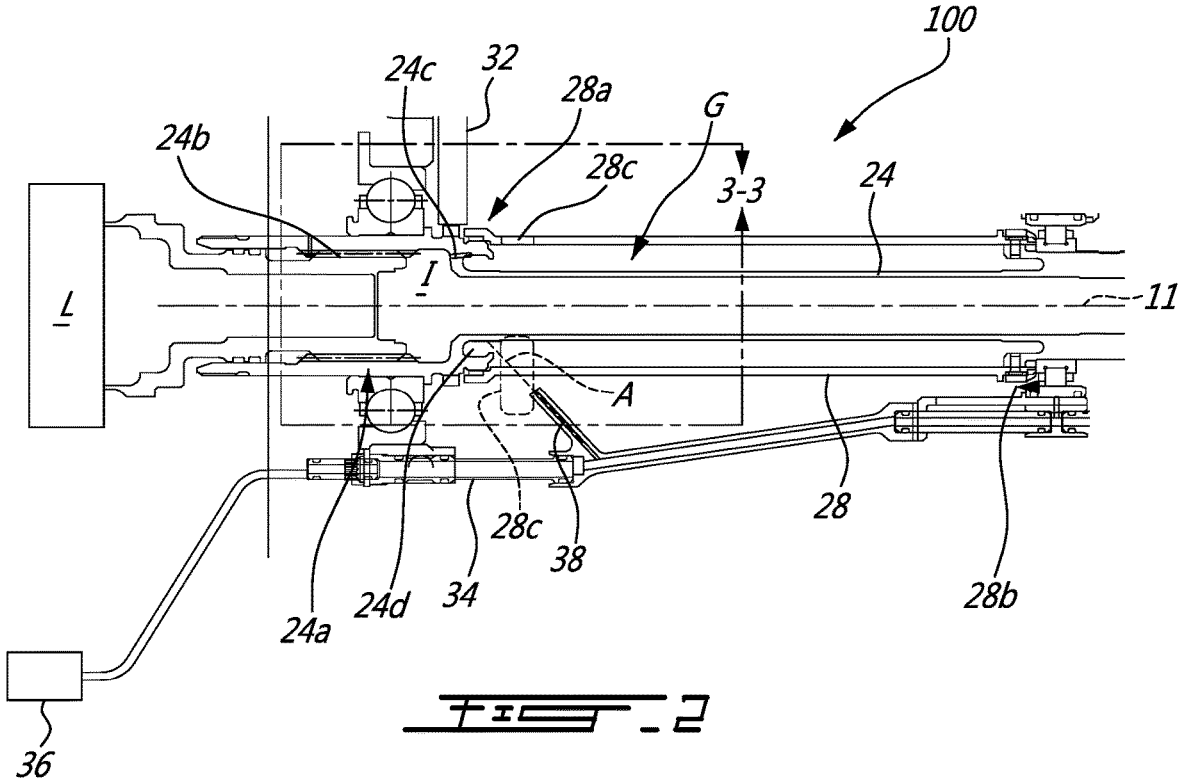
FIG. 2 is a schematic cross-sectional view of a portion of the gas turbine engine of FIG. 1.

Referring now to FIGS. 1-2, the low-pressure shaft 22 may be in driving engagement with a rotatable load L, which may be the fan 12 as illustrated in FIG. 1, via a torque shaft 24. The torque shaft 24 may be a portion of the low-pressure shaft 22. In other words, the torque shaft 24 and the low-pressure shaft 22 may be monolithic. The low-pressure shaft 22 and the torque shaft 24 may alternatively be two distinct components secured to one another. The torque shaft 24 may have an end 24*a* defining a spline 24*b*. In the embodiment shown, the spline 24*b* is defined on an inner side of the torque shaft 24, which is hollow in the embodiment shown. The spline 24*b* is matingly engaged with a correspondingly mating spline to allow a rotational input to the transmitted from the low-pressure shaft 22 to the rotatable load L. It will be appreciated that, although the rotatable load L is depicted as corresponding to the fan 12, the rotatable load may be, alternatively, a propeller, a helicopter rotor, an input of a reduction gearbox, an accessory, and so on.

In some cases, it may be required to lubricate the spline 24*b* for proper operation. This may be done by injecting oil toward the spline 24*b* from within an opposite end of the low-pressure shaft 22. However, in some cases, a length of the low-pressure shaft 22 is such that oil injected from the opposite end of the low-pressure shaft 22 may not reach the spline 24*b*. It is therefore contemplated herein to inject the oil toward the spline 24*b* from outside of the low-pressure shaft 22.

However, in the embodiment shown, the torque shaft 24 is part of an assembly 100 including a reference tube 28; the reference tube 28 circumferentially extending around the torque shaft 24. The reference tube 28 has a fore end 28*a* proximate to the spline 24*b* and an aft end 28*b* at an intersection between the torque shaft 24 and the low-pressure shaft 22. The aft end 28*b* of the reference tube 28 is secured to the torque shaft 24. Herein, fasteners are used to secure the aft end 28*b* of the reference tube 28 to the torque shaft 24. Other fastening means are contemplated. The fore end 28*a* of the reference tube 28 is rotatable relative to the torque shaft 24. A bearing may be disposed radially between the fore end 28*a* of the reference tube 28 and the torque shaft 24.

The combination of the torque shaft 24 and of the reference tube 28 may be used to measure the torque applied by the engine 10 on the rotatable load L. Dimensions of the torque shaft 24 are known and, in function of those dimensions, it may be possible to determine the torque transmitted by the low-pressure shaft 22 to the rotatable load L. This may be achieved by measuring a deformation of the torque shaft 24 as a result of the driving of the rotatable load L. This deformation is in a circumferential direction relative to the central axis 11. More specifically, a first reference point on the torque shaft 24 and axially aligned with the aft end 28*b* of the reference tube 28 may be circumferentially aligned with a second reference point on the torque shaft 24 and axially aligned with the fore end 28*a* of the reference tube 28 when the rotatable load L is at rest (non-rotating). Upon driving the rotatable load L, the first and second reference points may become circumferentially offset from one another. A magnitude of this offset increases with an increase of the torque transmitted by the low-pressure shaft 22 to the rotatable load L. A sensor 32 may be used to measure the magnitude of this offset. The sensor 32 may be operatively coupled to a controller that has instructions stored thereon to translate a value of the magnitude of the offset in a torque value. The reference tube 28 may be used herein to report the position of the second reference point at a location closer to the sensor 32. Indeed, since the fore end 28*a* of the reference tube 28 is free relative to the torque shaft 24 (i.e., it is not secured to the torque shaft 24; it is free; it is cantilevered; it is unconnected rigidly), the reference tube 28 may not be deformed following the transmission of a rotational input form the low-pressure shaft 22 to the rotatable load L via the torque shaft 24, as it is not used for load transmission—it is only rigidly connected to the shaft 24 or 22 aet one end, away from the sensor 32.

Figure 3:
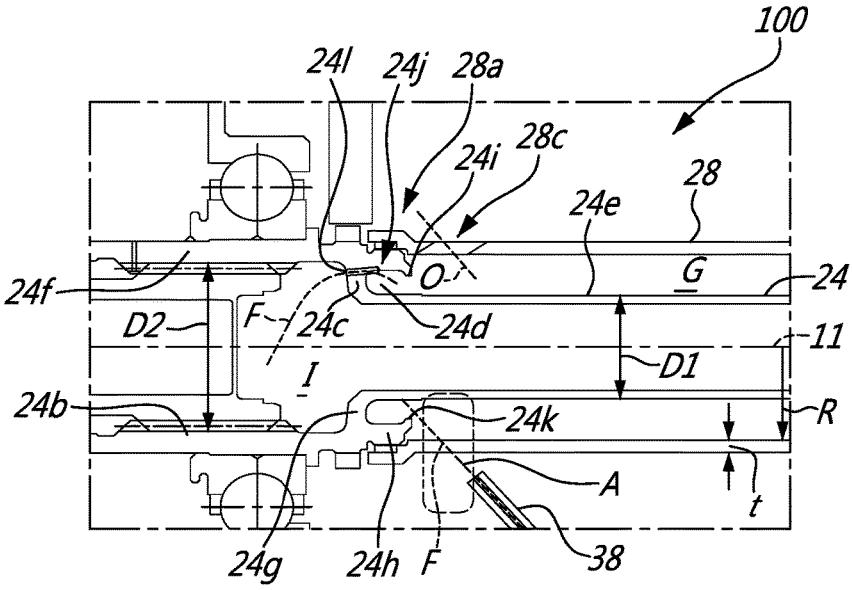
FIG. 3 is an enlarged view of a portion of FIG. 2.

Referring to FIGS. 2-3, the lubrication system may include a line 34 fluidly connected to a source of lubricant 36, such as an oil tank. A nozzle 38 is hydraulically connected to the line 34 and is configured to inject oil for lubricating the spline 24*b*. However, the nozzle 38 and the spline 24*b* are on respective opposite sides of the torque shaft 24.

To allow the oil to reach the spline 24*b*, one or more apertures 28*c*, referred to below as tube aperture 28*c*, is defined through the reference tube 28 to allow the oil to circulate within an annular gap G located radially between the torque shaft 24 and the reference tube 28. One or more apertures 24*c*, referred to below as shaft aperture, is defined through a wall of the torque shaft 24 to allow oil to circulate from the gap G to an interior I of the torque shaft 24 to reach the spline 24*b*. Both of the apertures 28*c*, 24*c* defined through the reference tube 28 and the torque shaft 24 may be located proximate to the fore end 28*a* of the reference tube 28 and in close proximity to the spline 24*b*. The aperture(s) 24*c* may extend generally or substantially axially. In an embodiment, the aperture(s) 24*c* is(are) an axial aperture(s).

Referring more particularly to FIG. 3, the torque shaft 24 may define a pool, or oil dam, 24*d* for receiving and accumulating oil jetted by the nozzle 38. In the depicted embodiment, the pool 24*d* is annular and extends circumferentially all around the central axis 11. The pool 24*d* is defined on an outer side of the torque shaft 24. More specifically, and in the embodiment shown, the torque shaft 24 has main section 24*e* and an end section 24*f*. The spline 24*b* is defined by the end section 24*f* of the shaft 24. A diameter D1 of the main section 24*e* is less than a diameter D2 of the end section 24*f*. The pool 24*d* is located proximate to the intersection between the main and end sections 24*e*, 24*f* of the torque shaft 24, though it may be elsewhere. In the embodiment shown, the change in diameter from D1 to D2 is abrupt such that the main and end sections 24*e*, 24*f* of the torque shaft 24 are connected by an annular wall section 24*g* of the torque shaft 24, or like step; the annular wall section 24*g* may extend substantially radially relative to the central axis 11 from the main section 24*e* to the end section 24*g*, or may have a radial component to its direction.

The torque shaft 24 may define an axial protrusion 24*h* that extends substantially axially along the central axis 11 and away from the spline 24*b* and from the annular wall section 24*g*. A lip 24*i* extends from an end of the axial protrusion 24*h*. The lip 24*i* extends radially inwardly toward the central axis 11. The pool 24*d* is defined by a cooperation of the annular wall section 24*g*, the axial protrusion 24*h*, and the lip 24*i*. The wall section 24*g*, the axial protrusions 24*h*, and the lip 24*i* may be annular and may extend circumferentially all around the central axis 11. These components may be monoblock parts of the shaft 24, or add-on components.

In the embodiment shown, the shaft aperture 24*c* defined through the torque shaft 24 extends generally axially through the annular wall section 24*g* of the torque shaft 24. The shaft aperture 24*c* has an inlet end 24*j*; a tip 24*k* of the lip 24*i* being located radially inwardly of the inlet end 24*j* of the shaft aperture 24*c*. That is, the tip 24*k* of the lip 24*i* may be closer to the central axis 11 than the inlet end 24*j* of the shaft aperture 24*c*. This may allow oil to accumulate in the pool 24*d* by centrifugal effect. The shaft aperture 24*c* has an outlet end 24*l* that may be radially aligned with the inlet end 24*j*. In the embodiment shown, the outlet end 24*l* of the shaft aperture 24*c* is located radially inwardly of the inlet end 24*j* such that the shaft aperture 24*c* slopes toward the central axis 11 from the inlet end 24*j* to the outlet end 24*l*. The slope may assist in directing the oil from the pool 24*d* to the spline 24*b*, again by the centrifugal effect. In a particular embodiment, the sloping may allow to recuperate a greater amount of oil before the shaft aperture 24*c* becomes blocked by a rotation of the shaft compared to a configuration in which the shaft aperture 24*c* is parallel to the central axis 11. The sloping may allow to scoop more oil compared to a configuration in which the shaft aperture 24*c* is parallel to the central axis 11.

As shown in FIG. 3, the exit flow axis A of the nozzle 38 may intersect the torque shaft 24 at a location that may be axially aligned with the pool 24*d* relative to the central axis 11. In other words, the nozzle 38 may be angled relative to the central axis to inject oil in proximity of the pool 24*d*. To reach the spline 24*b*, the oil injected by the nozzle 38 along the exit flow axis A, passes through the reference tube 28 via the tube aperture 28*c* defined therethrough, reaches the pool 24*d* where it may accumulate, and flows toward the spline 24*b* through the shaft aperture 24*c*. In other words, a flow path F, which is shown in dashed line in FIG. 3, extends from the nozzle 38, to the tube aperture 28*c* through the reference tube 28, to the gap G between the torque shaft 24 and the reference tube 28, to the pool 24*d*, to the shaft aperture 24*c* defined through the torque shaft 24 and to the spline 24*b*.

Figure 4:
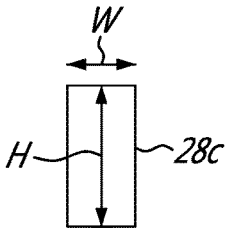
FIG. 4 is a schematic plan view of an aperture extending through a reference tube.

Referring to FIG. 4, in the embodiment shown, the tube aperture 28*c* has a length H in a circumferential direction relative to the central axis 11 and a width W in an axial direction relative to the central axis 11. The length H may be greater than the width W. The length H may be equal to or greater than a product of a rotational speed of the of the reference tube 28, a thickness t (FIG. 3) of the reference tube 28 taken in a radial direction relative to the central axis 11, and a radius R of the reference tube 28 divided by a velocity of the oil exiting the oil nozzle 38. In other words, a minimal value for the length H of the tube aperture 28*c* may correspond to a distance travelled by the oil to pass through the thickness t (FIG. 3) of the reference tube 28 and may be determined in function of relative velocities of the reference tube 28 and the oil exiting the nozzle 38. In other words, the shape of the tube aperture 28*c* may be elongated to increase the time the jet penetrates inside the reference tube 28. Width and length may vary to accommodate manufacturing need or optimize flow. Having the aperture 28 being elongated may allow for more oil to reach the pool 24*d* compared to configuration in which the aperture 28 are not elongated.

Increasing the length H of the tube aperture 28*c* may allow for more oil to be received in the pool 24*d* from the nozzle 38. Similar apertures may not be defined through the torque shaft 24 because they may impair its ability to transmit torque to the rotatable load L. And, if apertures similar to the tube aperture were defined through the torque shaft 24, they may be limited in length because of structural requirements of the torque shaft 24. Hence, the length of the aperture defined through the torque shaft 24 may be too short for allowing oil to pass therethrough. In other words, the shafts 22, 24 may be rotating too fast in relation to the velocity of the oil to have sufficient time to traverse the thickness of the torque shaft 24. The velocity of the oil may be function of operating pressure of the oil system.

Referring back to FIG. 3, the tube aperture 28*c* defined through the reference tube 28 may have an aperture axis O. The aperture axis O may have solely a radial component such that the aperture axis O is normal to the reference tube 28. Alternatively, the aperture axis O may further have a circumferential component and/or an axial component relative to the central axis 11. This may allow the tube aperture 28*c* to have a scooping effect. In other words, the tube aperture 28*c* may be machined normal to central axis 11 or at the same angle of incoming oil jet to create a scoop effect. More than one nozzle 38 may be used. The aperture axis O may be parallel to the exit flow axis A of the nozzle 38.

Spline may need to be lubricated. Engine output spline may need to be lubricated from the inside. Due to the integrated nature of the torque shaft to the pressure turbine shaft, the shaft may be too long for shooting oil from the inside of the shaft 22, 24. In the embodiment shown, lubrication is done by shooting oil from a nozzle through apertures 28*c* on the reference tube 28 while turning. Oil may then be captured in a dam 24*d* created by an additional lip 24*i* and may flow to the spline 24*b* through holes 24*c* in the torque shaft 24 to reach the internal spline 24*b*.

For lubricating the spline, oil is injected through the at least one tube aperture defined through the reference tube; the injected oil is directed toward the spline via at least one shaft aperture defined through the shaft; and the spline is lubricated with the injected oil.

Embodiments disclosed herein include:

A. A gas turbine engine, comprising: a shaft rotatable about a central axis and engaged at an end thereof to a rotatable load via a spline; a reference tube circumferentially extending around the shaft, the reference tube secured at a first end to the shaft for rotation therewith and a second end free relative to the shaft for measuring a deformation of the shaft, the reference tube defining at least one tube aperture therethrough; an oil nozzle fluidly connected to a source of lubricant, the oil nozzle defining an exit flow axis intersecting the at least one tube aperture for injecting oil through the reference tube, the shaft defining at least one shaft aperture extending therethrough, the oil nozzle aligned with the spline via the at least one tube aperture and the at least one shaft aperture.

B. A torque shaft assembly for a gas turbine engine, comprising: a shaft rotatable about a central axis and defining a spline at an end thereof for drivingly engaging a rotatable load; and a reference tube circumferentially extending around the shaft, the reference tube having a first end secured to the shaft for rotation therewith and a second end free relative to the shaft, the reference tube defining at least one tube aperture therethrough for receiving a jet of oil, the shaft defining at least one shaft aperture extending therethrough, a flow path extending from the at least one tube aperture to the spline via the at least one shaft aperture for lubricating the spline.

Embodiments A and B may include any of the following elements, in any combinations:

Element 1: the at least one tube aperture has a length in a circumferential direction relative to the central axis and a width in an axial direction relative to the central axis, the length greater than the width. Element 2: the at least one tube aperture has a length taken in a circumferential direction relative to the central axis, the length equal to or greater than a product of a rotational speed of the of the tube, a thickness of the tube in a radial direction, and a radius of the tube divided by a velocity of the oil exiting the oil nozzle. Element 3: the shaft defines a pool circumferentially extending around the central axis for receiving oil from the oil nozzle, the at least one shaft aperture in fluid flow communication with the pool. Element 4: the shaft has a main section and an end section, the end section defining the spline, a diameter of the main section less than that of the end section, the pool located proximate an intersection between the main section and the end section. Element 5: the exit flow axis intersects the shaft at a location axially aligned with the pool. Element 6: the shafts defines an axial protrusion and a lip extending from an end of the axial protrusion, the lip extending at least radially inwardly toward the central axis, the pool defined by the shaft at an intersection between the main and end sections, the axial protrusion, and the lip. Element 7: the at least one shaft aperture has an inlet end communicating with the pool, a tip of the lip located radially inwardly of the inlet end of the at least one shaft aperture. Element 8 the at least one tube aperture has an aperture axis parallel to the exit flow axis. Element 9: the at least one shaft aperture extends at least axially through the shaft at the intersection between the main and end sections. Element 10: the at least one tube aperture has a length taken in a circumferential direction relative to the central axis, the length equal to or greater than a product of a rotational speed of the of the tube, a thickness of the tube in a radial direction, and a radius of the tube divided by a velocity of the oil exiting the oil nozzle. Element 11: the shaft defines a pool circumferentially extending around the central axis for receiving oil from the oil nozzle, the at least one shaft aperture in fluid flow communication with the pool. Element 12: the shaft has a main section and an end section, the end section defining the spline, a diameter of the main section less than that of the end section, the pool located proximate an intersection between the main section and the end section. Element 13: the exit flow axis intersects the shaft at a location axially aligned with the pool. Element 14: the shafts defines an axial protrusion and a lip extending from an end of the axial protrusion, the lip extending at least radially inwardly toward the central axis, the pool defined by the shaft at an intersection between the main and end sections, the axial protrusion, and the lip. Element 15: the at least one shaft aperture has an inlet end communicating with the pool, a tip of the lip located radially inwardly of the inlet end of the at least one shaft aperture. Element 16: the at least one tube aperture has an aperture axis parallel to the exit flow axis. Element 17: the at least one shaft aperture extends at least axially through the shaft at the intersection between the main and end sections.

The embodiments described in this document provide non-limiting examples of possible implementations of the present technology. Upon review of the present disclosure, a person of ordinary skill in the art will recognize that changes may be made to the embodiments described herein without departing from the scope of the present technology. Yet further modifications could be implemented by a person of ordinary skill in the art in view of the present disclosure, which modifications would be within the scope of the present technology.

The invention claimed is:

1. A gas turbine engine, comprising: a shaft rotatable about a central axis and engaged at an end thereof to a rotatable load via a spline; a reference tube circumferentially extending around the shaft, the reference tube secured at a first end to the shaft for rotation therewith and a second end free relative to the shaft for measuring a deformation of the shaft, the reference tube defining at least one tube aperture therethrough; an oil nozzle fluidly connected to a source of lubricant, the oil nozzle defining an exit flow axis intersecting the at least one tube aperture for injecting oil through the reference tube, the shaft defining at least one shaft aperture extending therethrough, the oil nozzle aligned with the spline via the at least one tube aperture and the at least one shaft aperture.

2. The gas turbine engine of claim 1, wherein the at least one tube aperture has a length in a circumferential direction relative to the central axis and a width in an axial direction relative to the central axis, the length greater than the width.

3. The gas turbine engine of claim 1, wherein the at least one tube aperture has a length taken in a circumferential direction relative to the central axis, the length equal to or greater than a product of a rotational speed of the of the tube, a thickness of the tube in a radial direction, and a radius of the tube divided by a velocity of the oil exiting the oil nozzle.

4. The gas turbine engine of claim 1, wherein the shaft defines a pool circumferentially extending around the central axis for receiving oil from the oil nozzle, the at least one shaft aperture in fluid flow communication with the pool.

5. The gas turbine engine of claim 4, wherein the shaft has a main section and an end section, the end section defining the spline, a diameter of the main section less than that of the end section, the pool located proximate an intersection between the main section and the end section.

6. The gas turbine engine of claim 4, wherein the exit flow axis intersects the shaft at a location axially aligned with the pool.

7. The gas turbine engine of claim 4, wherein the shafts defines an axial protrusion and a lip extending from an end of the axial protrusion, the lip extending at least radially inwardly toward the central axis, the pool defined by the shaft at an intersection between the main and end sections, the axial protrusion, and the lip.

8. The gas turbine engine of claim 7, wherein the at least one shaft aperture has an inlet end communicating with the pool, a tip of the lip located radially inwardly of the inlet end of the at least one shaft aperture.

9. The gas turbine engine of claim 4, wherein the at least one shaft aperture extends at least axially through the shaft at the intersection between the main and end sections.

10. The gas turbine engine of claim 1, wherein the at least one tube aperture has an aperture axis parallel to the exit flow axis.

11. A torque shaft assembly for a gas turbine engine, comprising: a shaft rotatable about a central axis and defining a spline at an end thereof for drivingly engaging a rotatable load; and a reference tube circumferentially extending around the shaft, the reference tube having a first end secured to the shaft for rotation therewith and a second end free relative to the shaft, the reference tube defining at least one tube aperture therethrough for receiving a jet of oil, the shaft defining at least one shaft aperture extending therethrough, a flow path extending from the at least one tube aperture to the spline via the at least one shaft aperture for lubricating the spline.

12. The torque shaft assembly of claim 11, wherein the at least one tube aperture has a length taken in a circumferential direction relative to the central axis, the length equal to or greater than a product of a rotational speed of the of the tube, a thickness of the tube in a radial direction, and a radius of the tube divided by a velocity of the oil exiting the oil nozzle.

13. The torque shaft assembly of claim 11, wherein the shaft defines a pool circumferentially extending around the central axis for receiving oil from the oil nozzle, the at least one shaft aperture in fluid flow communication with the pool.

14. The torque shaft assembly of claim 13, wherein the shaft has a main section and an end section, the end section defining the spline, a diameter of the main section less than that of the end section, the pool located proximate an intersection between the main section and the end section.

15. The torque shaft assembly of claim 13, wherein the exit flow axis intersects the shaft at a location axially aligned with the pool.

16. The torque shaft assembly of claim 13, wherein the shafts defines an axial protrusion and a lip extending from an end of the axial protrusion, the lip extending at least radially inwardly toward the central axis, the pool defined by the shaft at an intersection between the main and end sections, the axial protrusion, and the lip.

17. The torque shaft assembly of claim 16, wherein the at least one shaft aperture has an inlet end communicating with the pool, a tip of the lip located radially inwardly of the inlet end of the at least one shaft aperture.

18. The torque shaft assembly of claim 13, wherein the at least one shaft aperture extends at least axially through the shaft at the intersection between the main and end sections.

19. The torque shaft assembly of claim 11, wherein the at least one tube aperture has an aperture axis parallel to the exit flow axis.

20. A method of lubricating a spline of a shaft of a gas turbine engine, the method comprising:

surrounding a shaft with a reference tube having a first end secured to the shaft and a second end free relative to the shaft;

injecting oil through at least one tube aperture defined through the reference tube;

directing the injected oil toward the spline via at least one shaft aperture defined through the shaft; and lubricating the spline with the injected oil.

* * * * *